US009397481B2

(12) United States Patent
Dirumdam

(10) Patent No.: US 9,397,481 B2
(45) Date of Patent: Jul. 19, 2016

(54) SPARK PLUG FOR AN INTERNAL COMBUSTION ENGINE

(71) Applicant: Björn Dirumdam, Ellgau (DE)

(72) Inventor: Björn Dirumdam, Ellgau (DE)

(73) Assignee: MAN Diesel & Turbo SE, Augsburg (DE)

( * ) Notice: Subject to any disclaimer, the term of this patent is extended or adjusted under 35 U.S.C. 154(b) by 335 days.

(21) Appl. No.: 13/894,098

(22) Filed: May 14, 2013

(65) Prior Publication Data

US 2014/0083386 A1 Mar. 27, 2014

(30) Foreign Application Priority Data

May 15, 2012 (DE) ..... 10 2012 208 085

(51) Int. Cl.

| | |
|---|---|
| ***H01T 13/00*** | (2006.01) |
| ***H01T 13/20*** | (2006.01) |
| ***H01T 13/40*** | (2006.01) |
| ***H01T 13/32*** | (2006.01) |
| ***H01T 13/46*** | (2006.01) |

(52) U.S. Cl.

CPC ..... *H01T 13/20* (2013.01); *H01T 13/32* (2013.01); *H01T 13/467* (2013.01)

(58) Field of Classification Search

CPC ..... H01T 13/20; H01T 13/54; H01T 13/16; H01T 13/24; H01T 13/40; H01T 13/28; F02B 19/12; F02B 23/08; F02B 19/1004; F02B 19/1014

USPC ..... 123/169 EL, 169 R–169 V

See application file for complete search history.

(56) References Cited

U.S. PATENT DOCUMENTS

| | | | | |
|---|---|---|---|---|
| 5,210,458 | A * | 5/1993 | McDougal | H01T 21/02 313/130 |
| 5,408,961 | A | 4/1995 | Smith | |
| 5,892,319 | A | 4/1999 | Rossi | |
| 6,104,130 | A * | 8/2000 | Below | H01T 13/08 123/169 EL |
| 7,256,533 | B2 | 8/2007 | Landon, Jr. | |
| 7,922,551 | B2 * | 4/2011 | Tozzi | F02B 19/08 123/169 EL |
| 2002/0055318 | A1 | 5/2002 | Ishiguro et al. | |
| 2007/0216276 | A1 * | 9/2007 | Takada | H01T 13/20 313/141 |
| 2009/0309475 | A1 | 12/2009 | Tozzi | |
| 2010/0133976 | A1 | 6/2010 | Siegel | |

FOREIGN PATENT DOCUMENTS

| | | |
|---|---|---|
| DE | 627 591 | 3/1936 |
| DE | 2444454 | 4/1975 |
| DE | 101 45 944 | 4/2003 |
| DE | 101 55 404 | 5/2003 |
| DE | 699 33 530 | 6/2007 |
| DE | 10 2008 061 242 | 6/2010 |
| JP | 03-11575 | 1/1991 |

* cited by examiner

*Primary Examiner* — Lindsay Low
*Assistant Examiner* — Syed O Hasan
(74) *Attorney, Agent, or Firm* — Cozen O'Connor

(57) ABSTRACT

Spark plug for an internal combustion engine, having a center electrode and a ground electrode. A spark gap is formed between the center electrode and ground electrode for igniting a fuel mixture by an electric ignition spark developing between the center electrode and the ground electrode. The center electrode and the ground electrode are contoured such that a ratio of a surface of the center electrode and the ground electrode, which is available for development of the ignition spark to a wear volume when an ignition spark is generated, is increased in such a way that an enlargement of the spark gap occurring as a result of wear when an ignition spark is generated is minimized.

5 Claims, 5 Drawing Sheets

SPARK PLUG FOR AN INTERNAL COMBUSTION ENGINE

BACKGROUND OF THE INVENTION

1. Field of the Invention

The invention is directed to a spark plug for an internal combustion engine and an internal combustion engine.

2. Description of the Related Art

Spark plugs are used for electric ignition of a fuel mixture to be burned in an internal combustion engine. Between a center electrode and a ground electrode of a spark plug there is a spark gap in which an electric ignition spark can be formed for igniting the fuel mixture. A basic distinction is made between spark plugs with a hooked ground electrode and spark plugs with an annular ground electrode. DE 10 2008 061 242 A1 shows an internal combustion engine with a spark plug having a hooked ground electrode, the spark gap extending axially between one end of the center electrode and one end of the hooked ground electrode viewed in axial direction of the center electrode. A spark plug with an annular ground electrode is known from DE 101 45 944 A1. In this case, the spark gap extends between the center electrode and the ground electrode in radial direction around the center electrode.

The surfaces of the ground electrode and center electrode of a spark plug between which an electric ignition spark is formed for igniting the fuel mixture are fabricated from noble metal or coated with noble metal. This noble metal is subject to wear when an ignition spark is generated.

As a result of this wear, the spark gap between the center electrode and the ground electrode increases in size and, as the spark gap becomes larger, more ignition energy must be applied to form the ignition spark. When the dimensions of the spark gap have exceeded a critical quantity, the spark plug must be exchanged.

SUMMARY OF THE INVENTION

It is an object of one embodiment of the invention to provide a novel spark plug for an internal combustion engine and an internal combustion engine with a spark plug of this kind.

According to one embodiment of the invention, the center electrode and the ground electrode are contoured such that a ratio of a surface of the center electrode and ground electrode, which is available for development of the ignition spark to a wear volume when an ignition spark is generated, is increased in such a way that an enlargement of the spark gap occurring as a result of wear when an ignition spark is generated is minimized.

One embodiment of the invention is a spark plug in which the center electrode and the ground electrode are contoured such that the ratio of the surface of the center electrode, and ground electrode which is available for development of the ignition spark to a wear volume when an ignition spark is generated, is increased in such a way that an enlargement of the spark gap occurring as a result of wear when an ignition spark is generated is minimized. In this way, the energy required for generating the ignition spark can be kept low on the one hand and the life of an ignition electrode can be prolonged on the other hand.

According to one embodiment of the invention, the center electrode has a plurality of segments, and the ground electrode is arranged in radial direction around each of the segments while forming a spark gap in each instance. This configuration of the ignition electrode is particularly advantageous and provides a particularly advantageous ratio of the surface of the center electrode and ground electrode which is available for development of the ignition spark to the wear volume when an ignition spark is generated. A spark plug of this kind uses with less ignition energy even in case of wear and has a long service life.

Surfaces of the center electrode and ground electrode bounding the spark gap or each spark gap are preferably contoured in a corrugated manner. By the corrugated contouring of the surfaces of the center electrode and ground electrode bounding the spark gap or every spark gap, the ratio of the surface of the center electrode and ground electrode, which is available for development of the ignition spark to the wear volume when an ignition spark is generated, can be further improved.

Preferred further developments of the invention are indicated in the subclaims and the following description. Embodiment examples of the invention are described more fully with reference to the drawings without the invention being limited to these embodiment examples.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

The present invention is directed to a spark plug for an internal combustion engine, particularly for an Otto gas engine, serving to ignite a fuel mixture to be burned in the internal combustion engine.

Figure 1A:
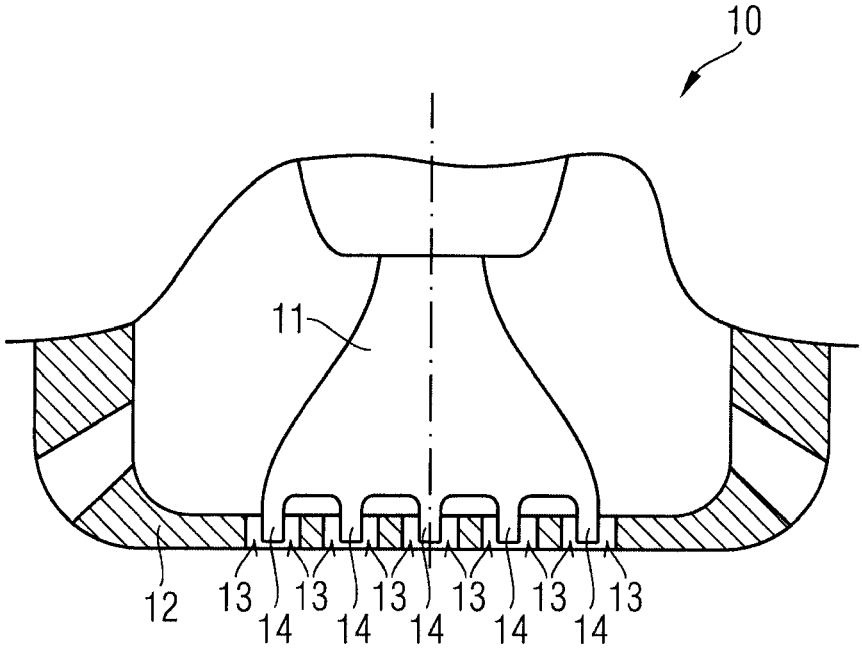
FIGS. 1*a* and 1*b* are schematic diagrams showing a first spark plug according to the invention.
Figure 1B:
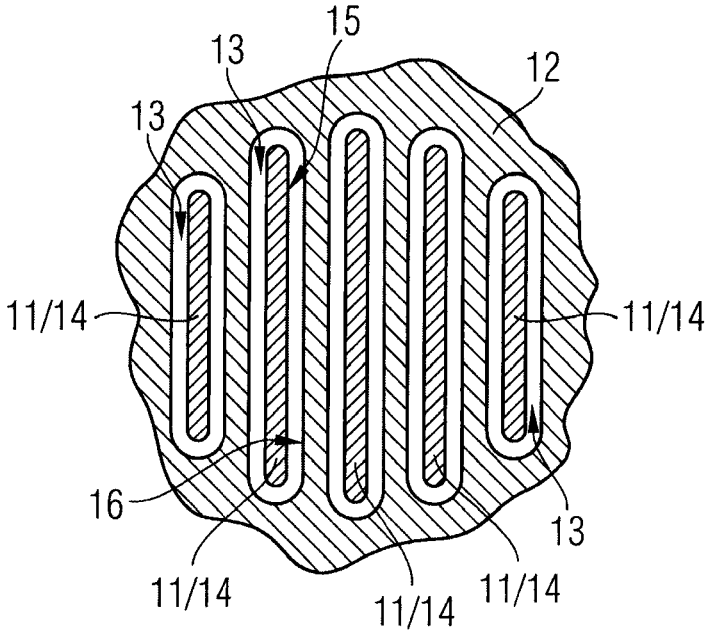

FIGS. 1*a* and 1*b* show a first, preferred embodiment of a spark plug 10 according to one embodiment of the invention. The spark plug 10 comprises a center electrode 11 and a ground electrode 12. At least one spark gap 13 is formed between the center electrode 11 and the ground electrode 12 for igniting the fuel mixture, and an electric ignition spark can be formed between the center electrode 11 and the ground electrode 12 to arc over the respective spark gap 13.

In the spark plug 10 according to the invention, the center electrode 11 and the ground electrode 12 are contoured such that a ratio of a surface of the center electrode 11 and ground electrode 12, which is available for development of the ignition spark to a wear volume when an ignition spark is generated, is increased in such a way that an enlargement of the spark gap 13 occurring as a result of wear when an ignition spark is generated is minimized.

In the embodiment example shown in FIGS. 1*a* and 1*b*, the ground electrode 12 is arranged around the center electrode 11 viewed in radial direction of the center electrode 11 accompanied by formation of a plurality of annular spark gaps 13.

In the embodiment example shown in FIGS. 1*a* and 1*b*, there are five annular spark gaps 13 arranged in radial direction around the center electrode 11.

In FIGS. 1*a* and 1*b*, the center electrode 11 has a plurality of segments 14 which are formed in FIGS. 1*a* and 1*b* as rectangular or oval webs or bars, a spark gap 13 with a rectangular or oval contour formed around each of these segments 14 viewed in radial direction of the center electrode 11.

By configuring the spark plug 10 with a plurality of spark gaps 13 in this way, a particularly advantageous ratio between the surface of the center electrode 11 and ground electrode 12 available for development of the ignition spark and the wear volume when an ignition spark is generated can be provided so that, in spite of wear of the spark plug 10 as a result of generating ignition sparks, only a slight increase in the ignition energy needed for ignition spark generation is required and, therefore, a longer service life of the ignition electrode can be ensured.

Figure 2:
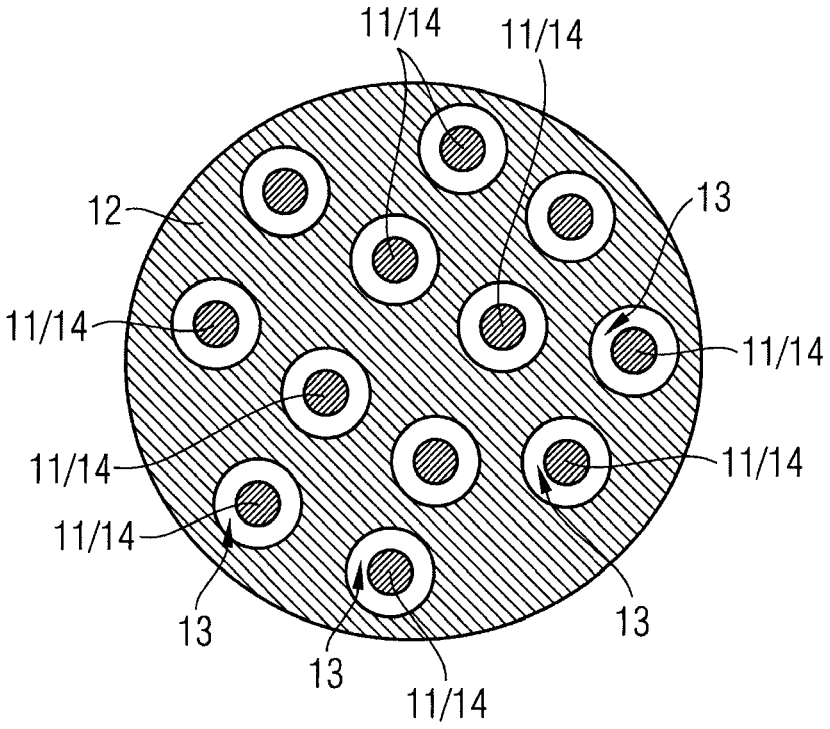
FIG. 2 is a schematic diagram analogous to FIG. 1*b* showing a second spark plug according to the invention.

FIG. 2 shows a variant of the spark plug according to the invention in the embodiment from FIGS. 1*a* and 1*b* in which a plurality of spark gaps 13 are likewise formed between the center electrode 11, namely the segments 14 thereof, and the ground electrode 12 viewed in radial direction; in contrast to the embodiment example from FIGS. 1*a* and 1*b*, however, the segments 14 of the center electrode 11 in the embodiment example in FIG. 2 are formed as projections which are circular in cross section, so that each spark gap 13 is contoured in a circular manner.

Figure 3A:
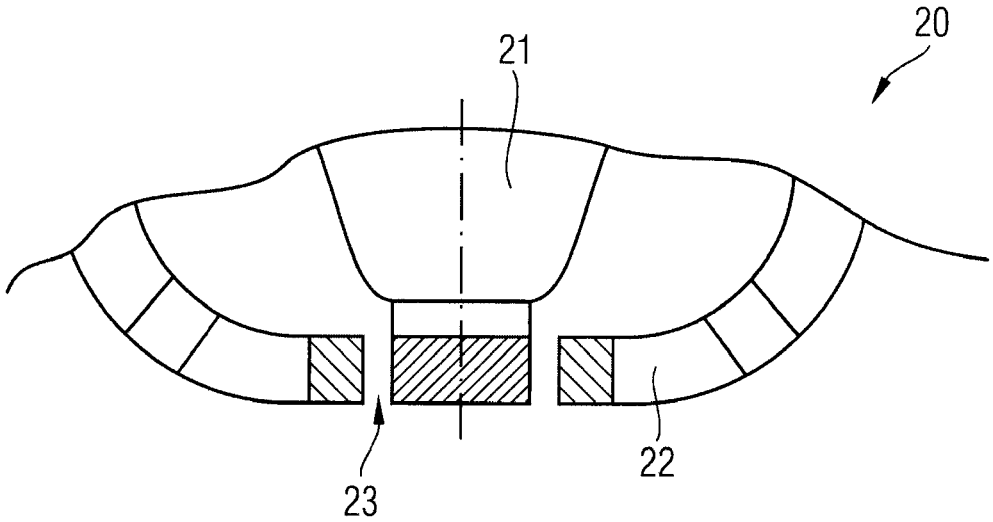
FIGS. 3*a* to 3*b* are schematic diagrams showing a third spark plug according to the invention.
Figure 3B:
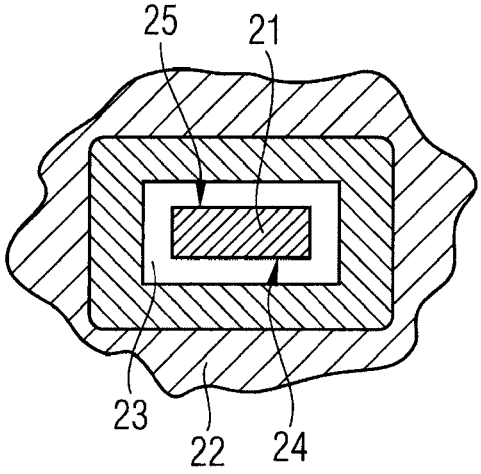

FIGS. 3*a* and 3*b* show an embodiment of a spark plug 20 that has a center electrode 21 and a ground electrode 22 in which the ground electrode 22 is positioned in radial direction around the center electrode 21 while forming an individual, annular, radial spark gap 23.

In the embodiment of FIGS. 3*a* and 3*b*, the center electrode 21 is contoured or shaped so as to be rectangular in cross section to provide a ratio, according to the invention, of the surface of the center electrode 21 and ground electrode 22, which is available for development of the ignition spark to the wear volume when an ignition spark is generated for minimizing the enlargement of the spark gap 23, as a consequence of ignition spark development. The center electrode 22 is arranged around the center electrode 21 in radial direction while forming the individual rectangularly contoured spark gap 23.

Figure 4:
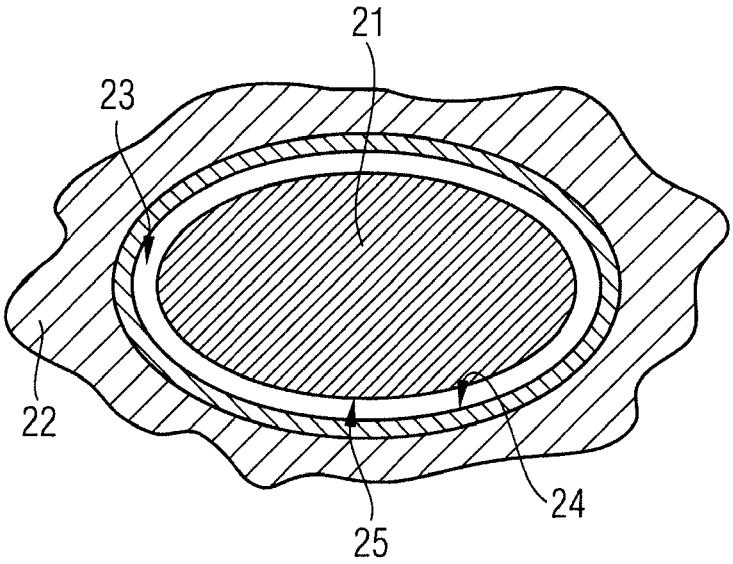
FIG. 4 is a schematic diagram analogous to FIG. 3*b* showing a fourth spark plug according to the invention.

FIG. 4 shows a modification of the ignition electrode 20 from FIGS. 3*a* and 3*b* in which the center electrode 21 is oval in cross section and in which an individual oval spark gap 23 is then formed and positioned between the center electrode 21 and ground electrode 22 in radial direction around the center electrode 21.

Figure 6A:
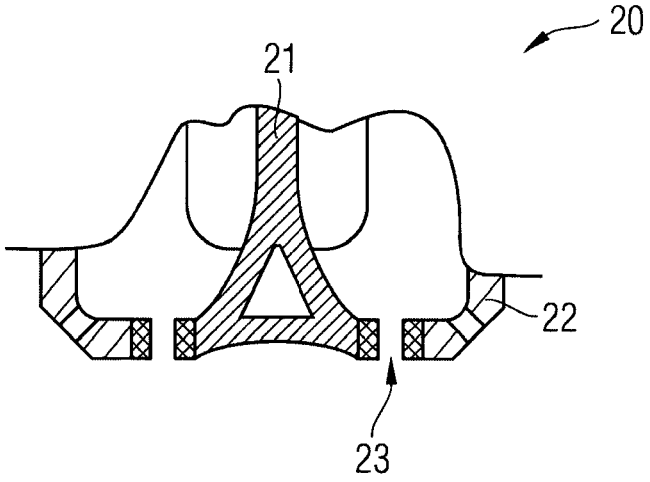
FIGS. 6*a* to 6*b* are schematic diagrams showing a sixth spark plug according to the invention.
Figure 6B:
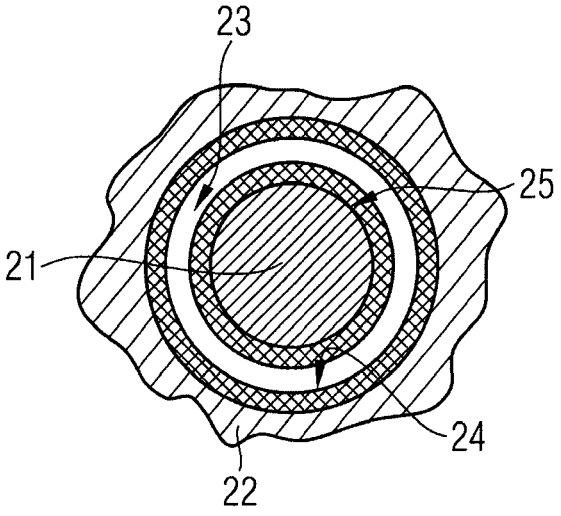

FIGS. 6*a* and 6*b* show another modification of the embodiment shown in FIGS. 3*a* and 3*b* in which an individual spark gap 23 is again formed around the center electrode 21 viewed in radial direction. In the embodiment of FIGS. 6*a* and 6*b*, the ratio, according to the invention, of the surface of center electrode 21 and ground electrode 22 which is available for development of the ignition spark to the wear volume when an ignition spark is generated is provided in such a way that the end of the center electrode 21 bounding the spark gap 23 is widened or formed in a toroidal shape in radial direction so that by increasing the radius of the annular spark gap 23 between the center electrode 21 and ground electrode 22 the desired ratio is provided between the surfaces of center electrode 21 and ground electrode 22 which are available for development of the ignition spark and the wear volume when an ignition spark is generated.

Figure 5:
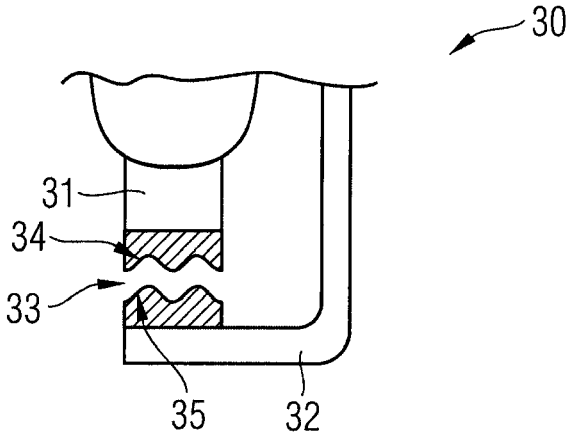
FIG. 5 is a schematic diagram analogous to FIG. 3*a* showing a fifth spark plug according to the invention.

FIG. 5 shows a further embodiment form of an ignition electrode 30 according to the invention with a center electrode 31 and a hooked ground electrode 32; namely, in FIG. 5, the spark gap 33 between the center electrode 31 and the ground electrode 32 is formed in axial direction between the electrodes 31 and 32 in that the ground electrode 32 is at a distance from the center electrode 31 in axial direction while forming the axial spark gap 33.

In so doing, the surfaces 34 and 35 of the electrodes 31 and 32 respectively bounding the spark gap 33 are contoured in a corrugated manner to provide the ratio, according to the invention, of the surface of the electrodes 11 and 12 available for development of the ignition spark to the wear volume when an ignition spark is generated.

It is noted that corresponding surfaces 15, 16 of center electrode 11 and ground electrode 12 or surfaces 24 and 25 of center electrode 21 and ground electrode 22, respectively, can also be contoured in a corrugated manner in the embodiments of FIGS. 1*a* to 4 in order to further increase the ratio of the surfaces of the electrodes available for development of the ignition spark to the wear volume when an ignition spark is generated.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A spark plug for an internal combustion engine, comprising:

a center electrode; and a ground electrode, wherein a spark gap is formed between the center electrode and the ground electrode for igniting a fuel mixture by an ignition spark developing between the center electrode and the ground electrode, wherein the center electrode and the ground electrode are contoured such that a ratio of a surface of the center electrode and a surface of the ground electrode available for development of the ignition spark to a wear volume when the ignition spark is generated is increased such that an enlargement of the spark gap due to wear when the ignition spark is generated is minimized, and wherein the center electrode has a plurality of segments, and the ground electrode is arranged in radial direction around each of the plurality of segments forms a respective spark gap, wherein the plurality of segments are configured as one of webs and bars that are one of rectangular and oval in cross section, and wherein each respective spark gap is one of rectangular and oval.

2. The spark plug according to claim 1, wherein the ground electrode is arranged at a distance from the center electrode in axial direction to form an axial spark gap.

3. The spark plug according to one of claim 1, wherein respective surfaces of the center electrode and the ground electrode that bound each respective spark gap are contoured in a corrugated manner.

4. A spark plug for an internal combustion engine, comprising:

a center electrode; and a ground electrode, wherein a spark gap is formed between the center electrode and the ground electrode for igniting a fuel mixture by an ignition spark developing between the center electrode and the ground electrode, wherein the center electrode and the ground electrode are contoured such that a ratio of a surface of the center electrode and a surface of the ground electrode available for development of the ignition spark to a wear volume when the ignition spark is generated is increased such that an enlargement of the spark gap due to wear when the ignition spark is generated is minimized, and wherein the center electrode has a plurality of segments, and the ground electrode is arranged in radial direction around each of the plurality of segments forms a respective spark gap, wherein the plurality of segments are projections that are circular in cross section, and each respective spark gap is contoured in a circular manner.

5. A spark plug for an internal combustion engine, comprising:

a center electrode; and a ground electrode, wherein a spark gap is formed between the center electrode and the ground electrode for igniting a fuel mixture by an ignition spark developing between the center electrode and the ground electrode, wherein the center electrode and the ground electrode are contoured such that a ratio of a surface of the center electrode and a surface of the ground electrode available for development of the ignition spark to a wear volume when the ignition spark is generated is increased such that an enlargement of the spark gap due to wear when the ignition spark is generated is minimized, and wherein respective surfaces of the center electrode and the ground electrode that bound the spark gap are contoured in a corrugated manner.

* * * * *